United States Patent [19]

Johnson et al.

[11] Patent Number: 4,725,802

[45] Date of Patent: Feb. 16, 1988

[54] SOLENOID ACTUATOR WITH STATIONARY ARMATURE EXTENSION

[75] Inventors: Terence L. Johnson, Bridgewater; James E. Greame, Long Valley, both of N.J.

[73] Assignee: Automatic Switch Company, Florham Park, N.J.

[21] Appl. No.: 15,736

[22] Filed: Feb. 17, 1987

[51] Int. Cl.[4] ..... H01F 7/08

[52] U.S. Cl. ..... 335/258; 335/262

[58] Field of Search ..... 335/255, 258, 259, 260, 335/262

[56] References Cited

U.S. PATENT DOCUMENTS 2,458,123 1/1949 Wasserlein ..... 335/262 X

FOREIGN PATENT DOCUMENTS 2236586 2/1974 Fed. Rep. of Germany ..... 335/262

19266 1/1970 Japan ..... 335/262

*Primary Examiner*—George Harris

*Attorney, Agent, or Firm*—Alan H. Levine

[57] ABSTRACT

A solenoid actuator including a coil of electrically conductive wire having a central opening, a yoke of magnetic material permanently surrounding the coil, and a stationary armature permanently secured to the yoke and projecting from the yoke into the central opening in the coil. A core tube of non-magnetic material is removably retained within the central opening in the coil, the core tube having a closed end engaging the stationary armature and the core tube being separable from the coil-yoke-armature assembly. A movable armature within the core tube is slidable toward and away from the stationary armature. A stationary armature extension of magnetic material surrounds the exterior of the core tube, the extensions being an element independent of the stationary armature. The extension may be an annular element, coaxial with the core tube, which engages the stationary armature. The extension may be a ring having a wall of uniform or non-uniform thickness along its length. Stationary armature extensions of different lengths are used, depending upon the size of the air gap between the movable armature and the stationary armature when the solenoid coil is deenergized.

12 Claims, 6 Drawing Figures

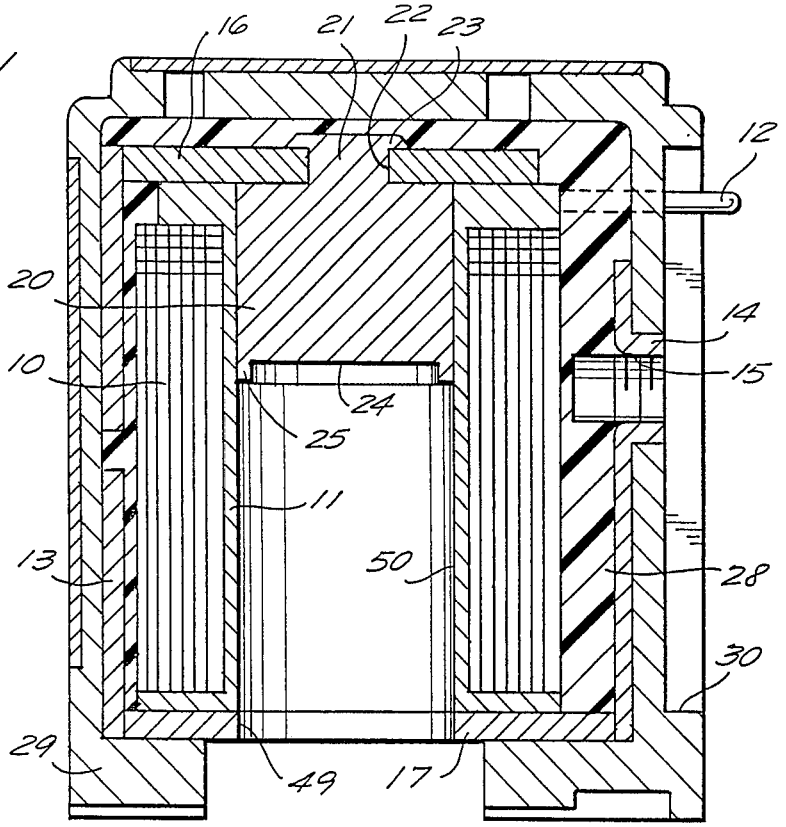
FIG. 2
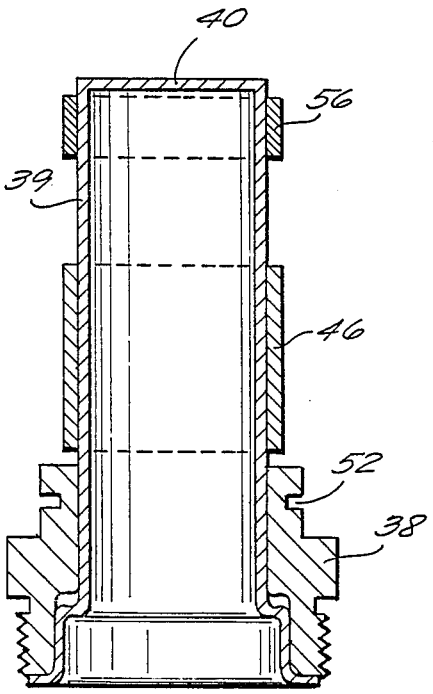

SOLENOID ACTUATOR WITH STATIONARY ARMATURE EXTENSION

This invention relates to solenoid actuators which are used to operate a wide variety of devices in response to electrical signals. For example, solenoid actuators are commonly used to open and close valves which control the flow of fluids.

Typically, a solenoid actuator includes a coil of electric wire, a steel yoke surrounding the coil to define a magnetic circuit, and a plastic encapsulation around the yoke and coil. At its center, the encapsulated coil has an axial hole for accommodating a core tube which contains a stationary armature and a movable armature which moves toward and away from the stationary armature in response to electrical signals received by the coil. The encapsulated coil is assembled with the core tube by slipping the coil over the core tube, so that the core tube extends through the hole in the coil.

An improved solenoid actuator is described and illustrated in copending applications Ser. No. 793,208, filed Oct. 31, 1985, now U.S. Pat. No. 4,683,454, Ser. No. 796,757, filed Nov. 12, 1985, now U.S. Pat. No. 4,679,767 and Ser. No. 801,466, filed Nov. 25, 1985, now U.S. Pat. No. 4,658,453, each of these applications being assigned to the assignee of the present application. In the improved actuator, the stationary armature is located externally of the core tube, and is permanently fixed to the yoke. The plastic-encapsulated coil, yoke, and stationary armature unit can be slipped over the closed end of the core tube, the opposite end of which carries a mounting member for securing the core tube to a device, such as a valve, to be controlled by the solenoid actuator. Modules are provided which can be plugged into the encapsulated unit, to supply electric power to the coil, and the encapsulation is furnished with a spring clip for movably securing the encapsulated unit to the mounting member.

A major advantage of the improved solenoid actuator described above is that the same encapsulated coil, yoke, and stationary armature unit can be used in a wide variety of installations, simply by selection of the appropriate module to be used with the encapsulated unit. Consequently, it is not necessary to maintain an inventory of different solenoid actuators for different purposes. However, a problem is presented when the encapsulated unit is to be used with different movable armatures having varying stroke lengths. Different devices to be controlled by the solenoid actuator often require that the movable armature move through different distances between the position which the movable armature occupies when the solenoid coil is deenergized and the position which it moves to when the coil is energized. Since a standard length core tube is employed, changing the stroke of the movable armature is accomplished by using movable armatures having different lengths, so that in the deenergized condition of the coil, the air gap between the movable armature and the stationary armature is greater or lesser, as required.

When a DC solenoid is used, the amount of magnetomotive force needed to move the movable armature increases with increase in the air gap between the movable armature and the stationary armature. An increased magnetomotive force requirement necessitates energizing the coil with higher current, or power. To reduce the power requirement, without reducing the length of the movable armature stroke, it is common practice to shape the opposing faces of the stationary and movable armatures, so as to make them other than flat. For example, these opposed faces are often given a conical, or frusto-conical shape, as shown in the three copending applications mentioned above. Such shaping can provide a relatively large axial distance between the stationary and movable armatures, so as to permit a relatively long stroke, while presenting a relatively small radial air gap between the two armatures.

However, different shapes for the opposed armature faces must be used for different stroke lengths and other variations in the requirements of an actuator for operating a particular device. On the other hand, the major benefit sought to be achieved by the encapsulated coil, yoke, and stationary armature unit of the three copending applications identified above is that the exact same unit can be used in solenoid actuators having different requirements. Thus, if such encapsulated units are to be employed, a single standard stationary armature already forms a permanent part of the unit. Hence, the opportunity for shaping the face of the stationary armature is not present, if only a single such unit is to be made available.

It is an object of the present invention to overcome this problem by providing such a solenoid actuator, in which a standard stationary armature forms a permanent part of the yoke which surrounds the solenoid coil, wherein the stationary armature can nevertheless be effectively reshaped to maximize the efficiency of the actuator regardless of the stroke length of the movable armature.

It is another object of the invention to provide such a solenoid actuator in which the stationary armature face is reshaped by effectively extending the stationary armature into the region surrounding the core tube.

It is a further object of the invention to provide stationary armature extensions having different lengths, such extensions being elements independant of the stationary armature.

It is an additional object of the invention to provide such a solenoid actuator wherein the extensions themselves can be shaped, such as by making the wall thickness of the extension uniform or non-uniform along the length of the extension, so as to further improve the efficiency of operation of the actuator.

Additional features and advantages of the invention will be apparent from the following description, in which reference is made to the accompanying drawings.

In the drawings:

FIG. 2 is an exploded cross-sectional view of the actuator; and

Figure 1:
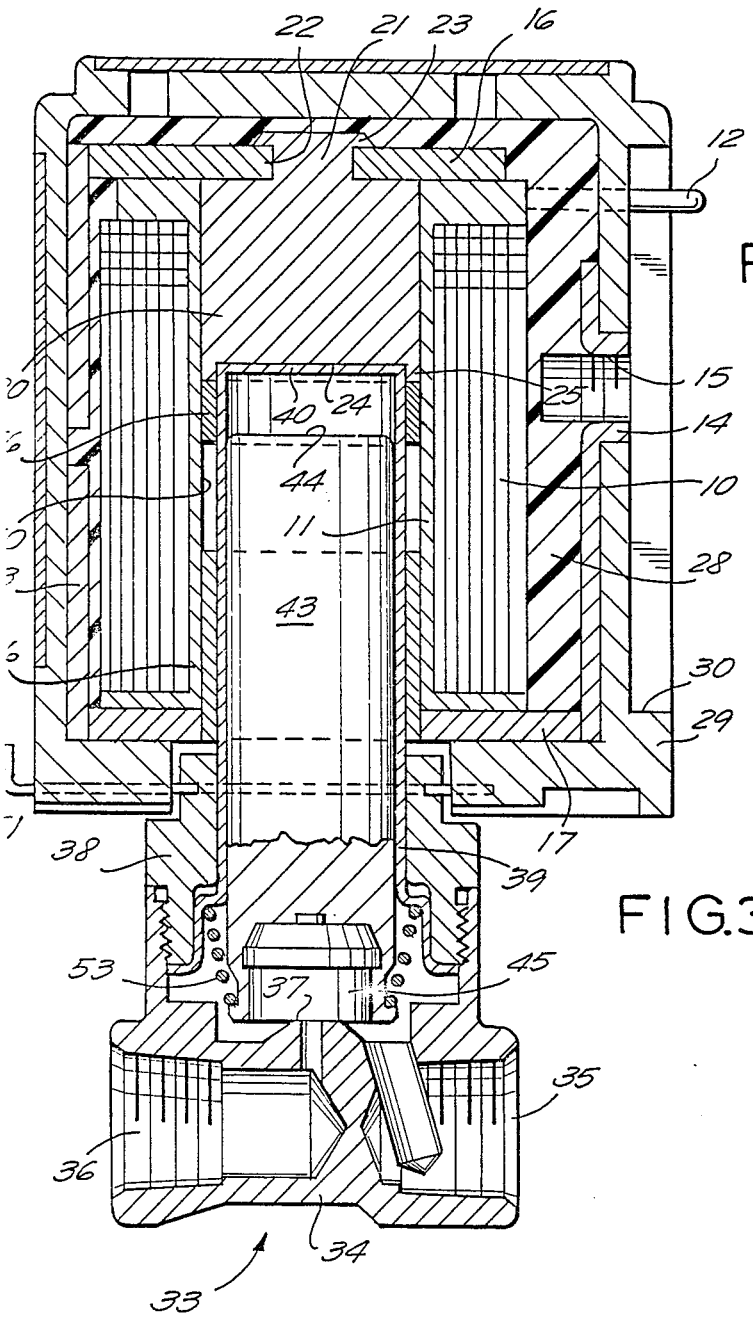
FIG. 1 is a cross-sectional view of a solenoid actuator, according the present invention, used to operate a valve.

Referring to FIGS. 1 and 2, the solenoid actuator chosen to illustrate the present invention includes a coil of electrically conductive wire 10 wound upon a spool 11 made of non-electrically and non-magnetically conductive material. The two ends of coil 10 are connected to a pair of pins 12, respectively, which serve as electrical terminals for the coil.

The yoke includes a side wall 13 carrying an outwardly projecting boss 14, the boss surrounding an internally threaded hole 15 which extends completely through the thickness of wall 13.

The internal dimensions of side wall 13 are sized to completely accommodate coil 10 and spool 11. When the coil and spool are inserted into the side wall, the side wall is radially spaced from the spool and coil, and pin terminals 12 extend outwardly beyond the side wall 13 through a notch (not shown) in the side wall. The yoke also includes a top wall 16 and a bottom wall 17 both of magnetic material, preferably steel. The side wall 13, top wall 16, and bottom wall 17 provide a box-like housing which substantially completely encloses coil 10 and spool 11.

Fixed to, and projecting downwardly from, the center of top wall 16 is a cylindrical stationary armature, or plug nut, 20, also formed of a magnetic material, such as steel. The upper end 21 of armature 20 is reduced in diameter and passes through a hole 22 in top wall 16. The upper end 23 of portion 21 is enlarged so as to permanently join together stationary armature 20 and top wall 16. The lower face 24 of stationary armature 20 may be completely flat, or have any other desired shape. Preferably, the bottom face 24 is formed with a peripheral annular ridge 25, as shown in the drawings.

After the coil 10 and yoke 13, 16, 17 are assembled, the space between coil 10 and side wall 13 is filled with a plastic material 28, e.g., an epoxy resin. The plastic 28 not only fills the space between coil 10 and side wall 13, but also covers the top wall 16. Thereafter, the parts are placed into a mold, and another plastic material 29, e.g., nylon, is molded around substantially the entire outside of the unit. On its front face, encapsulation 29 may be formed with a depression 30 for accommodating an electrical connection module (not shown) used to connect coil terminals 12 to a source of electric power. Threaded hole 15 is adapted to receive a threaded bolt for securing the module to the solenoid actuator.

The solenoid actuator according to this invention may be used to operate a wide variety of devices. An example of such devices is the valve 33 shown in FIG. 1. Valve 33 includes a valve body 34 having a fluid inlet port 35, a fluid outlet port 36, and a valve seat 37 between those ports. A mounting member, or bonnet, 38 is threaded into the valve body, the mounting member carrying a non-magnetic core tube 39. The core tube is closed at its upper end, the upper end wall 40 of the core tube being flat, in the present example, so as to meet squarely the flat lower face 24 of stationary armature 20. Furthermore, the external diameter of at least the upper end of core tube 39 is sized to fit snugly within the annular ridge 25 projecting downwardly from armature 20.

Slidable within core tube 39 is a movable armature 43 formed of magnetic material, the upper end face 44 of the armature being flat so as to conform to the flat surface of upper end wall 40 of core tube 39. If the lower face 24 of stationary armature 20 has some shape other than planar, core tube end wall 40 and upper end face 44 of the movable armature will be similarly shaped. The lower end of movable armature 43 carries a valve element 45 of resilient material adapted to cooperate with valve seat 37. Surrounding, and preferably fixed to, core tube 39 is a tubular sleeve 46, preferably of steel. Sleeve 46 is so located on core tube 39 that when the core tube is assembled with the unit encapsulated by plastic 29, the lower end of sleeve 46 engages bottom wall 17 of the yoke, as shown in FIG. 1.

The solenoid actuator is assembled by sliding core tube 39, carrying sleeve 46, through a central hole 49 in yoke bottom wall 17, and central axial opening 50 in spool 11. This movement is continued until upper end wall 40 of the core tube meets lower face 24 of stationary armature 20. A spring clip 51 (FIG. 1), slidable within encapsulation 29, is then moved to engage an annular slot 52 (FIG. 2) in mounting member 38 so as to hold the solenoid actuator together. Prior to insertion of core tube 39 into spool opening 50, mounting member 38 is threaded into valve body 34, so that spring clip 51 effectively holds together the solenoid actuator and the valve. By manipulating spring clip 51, the interconnection between encapsulation 29 and mounting member 38 can be released so as to permit disassembly of the parts, as shown in FIG. 2.

In FIG. 1, coil 10 is deenergized, and hence a spring 53 holds valve disc 45 against valve seat 37 to close the valve. When coil 10 is energized, movable armature 43 rises within core tube 39, to close the gap shown between the top end face 44 of the movable armature and the upper end wall 40 of the core tube, thereby lifting valve disc 45 off valve seat 37 to open the valve.

In cases where only a short stroke of movable armature 43 is required, so that only a small air gap is present between end face 44 and end wall 40, the solenoid actuator operates satisfactorily and efficiently without any need for augmenting stationary armature 20. However, as the required stroke of armature 43 increases, so that the air gap between end face 44 and core tube end wall 40 is larger, when coil 10 is deenergized, the magnetomotive force required to attract the movable armature to stationary armature 20 increases, thereby increasing the power requirements of the actuator to unsatisfactory levels. To avoid this undesirable result, the present invention employs stationary armature extensions of various lengths, the particular length used depending upon the size of the air gap between the armature 43 and the top wall 40 of the core tube.

In the present example, each stationary armature extension is in the form of an annular element, or ring 56 (FIGS. 1 and 2) adapted to fit snugly, but slidably, around core tube 39 in coaxial relation therewith. Ring 56 is placed around core tube 39 before the core tube is inserted through hole 49 and opening 50. Preferably, ring 56 is only partially inserted upon core tube 39, so that the ring projects slightly above end wall 40. Then, as core tube 39 completes its movement into opening 50, the upper edge of ring 56 engages the lower edge of ridge 25, so that during the final movement of core tube 39 into opening 50, ridge 25 pushes ring 56 further on to core tube 39. In this way, good contact between ridge 25 and ring 56 is assured.

As shown in FIG. 1, ring 56 effectively extends stationary armature 20 downwardly along the length of core tube 39. If ring 56 were not present, the smallest air gap between movable armature 43 and stationary armature 20 would be the distance between the upper end of armature 43 and the lower end of ridge 25. However, with ring 56 present, the air gap between the movable and stationary armatures is only the radial distance between armature 43 and ring 56 represented by the thickness of the side wall of core tube 39. This reduction in the air gap between the stationary and movable armatures, when coil 10 is deenergized, significantly reduces the magnetomotive force required to shift the movable armature upwardly to the top wall 40 of the core tube, thereby significantly reducing the power required to operate the solenoid actuator.

Figure 3A:
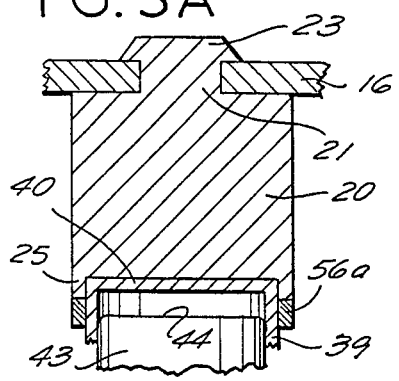
FIGS. 3A–3D are fragmentary cross-sectional views of the stationary armature, core tube, and movable armature together with stationary armature extensions having different lengths and shapes.
Figure 3B:
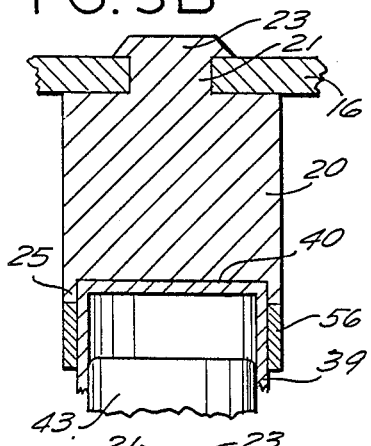
Figure 3C:
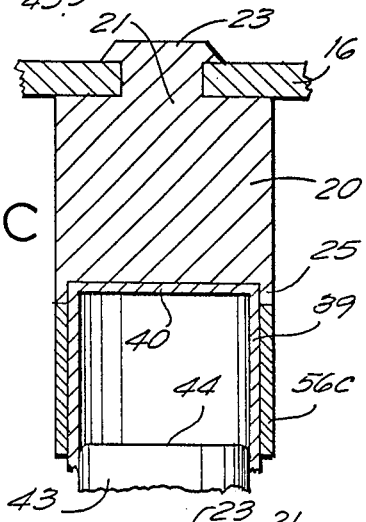

Armature extension ring 56 has the optimum length for the air gap shown in FIGS. 1 and 3B. Where the air gap present, in the deenergized solenoid actuator, is smaller than that of FIG. 1, such as is shown in FIG. 3A, a stationary armature extension ring 56*a* will be employed, in place of ring 56. Ring 56*a* is identical in diameter to that of ring 56, but is of shorter axial length. Likewise, where the air gap between end face 44 and core top wall 40 is larger, as shown in FIG. 3C, an armature extension ring 56*c*, longer than ring 56, will be used.

Figure 3D:
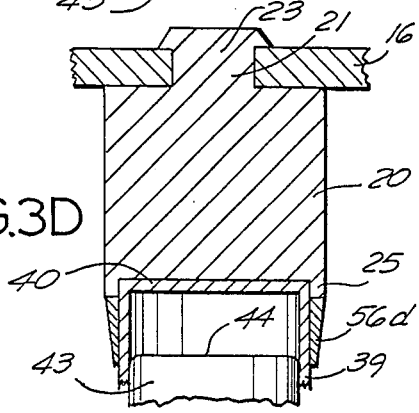

In general, the longer the stroke of armature 43 and the longer the length of stationary armature extension 56, the more the force on armature 43 decreases as it moves toward stationary armature 20. In an extreme case, this force can drop to zero before the movable armature reaches the upper end of core tube 39. Consequently, in some arrangements, it is desirable to shape the wall thickness of the extension ring so as to ensure efficient and proper operation of the solenoid actuator. For example, as shown in FIG. 3D, the wall thickness of ring 56*d* tapers in a direction away from stationary armature 20. This may be compared to rings 56, 56*a*, and 56*c*, in which the wall thickness of each ring is uniform along its entire length. The thinner lower end of ring 56*d* causes the ring to magnetically saturate earlier in the upward movement of armature 43, thereby leaving sufficient magnetic flux to continue movement of the armature until it completes its stroke.

Thus, it will be appreciated that although different length movable armatures 43 may be employed, producing different size air gaps between those armatures and top wall 40 of core tube 39, when the actuator is deenergized, the very same encapsulated unit, comprising coil 10, yoke 13, 16, 17, and stationary armature 20, can nevertheless be employed. All that need be done is use an appropriate length, or shaped, extension ring 56.

It may be mentioned that in no case should the lengths of extension 56 and sleeve 46 be such that these two elements touch, since a magnetic short circuit would then be created detracting from the magnetic flux passing through the movable armature. In fact, a minimum distance, e.g., at least about one-eighth inch, should always be maintained between extension 56 and sleeve 46.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A solenoid actuator comprising:

a coil of electrically conductive wire having a central opening, a yoke of magnetic material permanently surrounding the coil, a stationary armature permanently secured to the yoke, the armature projecting from the yoke into the central opening in the coil, a core tube of non-magnetic material removably retained within the central opening in the coil, the core tube having a closed end engaging the stationary armature and the core tube being separable from the coil-yoke-armature assembly, a movable armature within the core tube slidable toward and away from the stationary armature, and a stationary armature extension of magnetic material surrounding the exterior of the core tube, the extension being an element independant of the stationary armature.

2. A solenoid actuator as defined in claim 1 including retaining means for interlocking the core tube and the coil-yoke-armature assembly, the retaining means being movable to release the interlock and permit separation of the core tube from the assembly.

3. A solenoid actuator as defined in claim 1 wherein the yoke is encapsulated by a plastic resin.

4. A solenoid actuator as defined in claim 1 including a mounting element, fixed to the core tube at a point remote from its closed end, for securing the solenoid actuator to a device to be operated by the actuator.

5. A solenoid actuator as defined in claim 1 wherein the core tube is cylindrical, and the stationary armature extension is an annular element coaxial with the core tube.

6. A solenoid actuator as defined in claim 5 wherein the extension engages the stationary armature.

7. A solenoid actuator as defined in claim 6 including a sleeve of magnetic material surrounding the core tube and engaging the yoke, the sleeve being spaced from the extension.

8. A solenoid actuator as defined in claim 1 including a plurality of stationary armature extensions, each extension having a length, along the axis of the core tube, different from the lengths of the other extensions, and the different extensions being interchangeable to vary the elongation of the stationary armature in the direction of the axis of the core tube.

9. A solenoid actuator as defined in claim 1 wherein the stationary armature extension is a ring defined by an annular wall, the wall being of uniform thickness along the full length of the ring.

10. A solenoid actuator as defined in claim 1 wherein the stationary armature extension is a ring defined by an annular wall, the wall being of non-uniform thickness along the length of the ring.

11. A solenoid actuator as defined in claim 10 wherein the wall of the ring tapers in thickness in a direction away from the stationary armature.

12. A solenoid actuator as defined in claim 1 in combination with a valve, the valve including a valve body having an inlet port, an outlet port, and a valve seat between the ports, and a valve member carried by the movable armature and movable therewith toward and away from the valve seat, and a mounting element for securing the end of the core tube, remote from the stationary armature, to the valve body.

* * * * *